US006820935B1

(12) United States Patent
Cioncada

(10) Patent No.: US 6,820,935 B1
(45) Date of Patent: Nov. 23, 2004

(54) ARMCHAIR WITH VARIABLE POSITION

(76) Inventor: Enrico Cioncada, Viale del Bosco, 1-84100 Salerno (IT)

( * ) Notice: Subject to any disclaimer, the term of this patent is extended or adjusted under 35 U.S.C. 154(b) by 0 days.

(21) Appl. No.: 10/398,826

(22) PCT Filed: Oct. 16, 2001

(86) PCT No.: PCT/EP01/11923

§ 371 (c)(1),
(2), (4) Date: Apr. 9, 2003

(87) PCT Pub. No.: WO02/32260

PCT Pub. Date: Apr. 25, 2002

(30) Foreign Application Priority Data

Oct. 18, 2000 (IT) ..... VI2000A0226

(51) Int. Cl.[7] ..... A47C 1/032

(52) U.S. Cl. ..... 297/300.1; 297/300.3; 297/300.5; 297/320; 297/322

(58) Field of Search ..... 297/320, 322, 297/300.3, 300.5, 303.2, 303.4, 303.5, 314

(56) References Cited

U.S. PATENT DOCUMENTS

| | | | | | |
|---|---|---|---|---|---|
| 2,471,024 | A | * | 5/1949 | Cramer | 297/300.5 |
| 4,640,548 | A | | 2/1987 | Desanta | 297/320 |
| 4,709,963 | A | * | 12/1987 | Uecker et al. | 297/300.5 |
| 4,711,491 | A | * | 12/1987 | Ginat | 297/300.5 |
| 4,758,045 | A | * | 7/1988 | Edel et al. | 297/300.3 X |
| 4,776,633 | A | * | 10/1988 | Knoblock et al. | 297/322 X |
| 4,865,384 | A | * | 9/1989 | Desanta | 297/320 X |
| 4,962,962 | A | * | 10/1990 | Machate et al. | 297/300.5 |
| 4,986,601 | A | | 1/1991 | Inoue | 297/320 X |
| 5,071,189 | A | * | 12/1991 | Kratz | 297/300.1 |
| 5,251,958 | A | * | 10/1993 | Roericht et al. | 297/322 X |
| 5,725,277 | A | * | 3/1998 | Knoblock | 297/322 X |
| 5,810,439 | A | * | 9/1998 | Roslund, Jr. | 297/322 X |
| 5,826,940 | A | * | 10/1998 | Hodgdon | 297/320 X |
| 5,944,382 | A | * | 8/1999 | Ambasz | 297/300.1 |
| 5,979,988 | A | | 11/1999 | Heidmann et al. | 297/440.14 |
| 6,086,153 | A | * | 7/2000 | Heidmann et al. | 297/300.5 X |
| 6,109,694 | A | * | 8/2000 | Kurtz | 297/320 |
| 6,116,687 | A | | 9/2000 | Vogtherr | 297/300.1 |
| 6,161,897 | A | * | 12/2000 | Kurtz et al. | 297/320 X |
| 6,523,898 | B1 | * | 2/2003 | Ball et al. | 297/320 |
| 6,609,755 | B2 | * | 8/2003 | Koepke et al. | 297/300.3 X |
| 6,669,292 | B2 | * | 12/2003 | Koepke et al. | 297/322 X |
| 2002/0180248 | A1 | * | 12/2002 | Kinoshita et al. | 297/322 X |
| 2002/0190554 | A1 | * | 12/2002 | Kinoshita et al. | 297/300.3 |
| 2003/0137173 | A1 | * | 7/2003 | Kinoshita et al. | 297/300.3 |

* cited by examiner

*Primary Examiner*—Rodney B White
(74) *Attorney, Agent, or Firm*—Dykema Gossett PLLC

(57) ABSTRACT

The invention discloses an armchair (1) with variable position comprising a support structure (2) having a post (3) defining a first vertical axis (Z), a first frame (8) comprising a first pivot (9) defining a second horizontal axis (X), a second frame (12) swinging at one end (11) around the first pivot (9), thrust means (14) connected to the first frame (8) and acting against the end (11) of frame (12) to resist its swinging movement around the axis (X), a seat (10) supported by the first frame (8) and a backrest (13) supported by the second frame (12). The seat (10) is connected at least to the first frame (8) through first elastic means (15) adapted to allow a rotary translatory motion to the seat (10). The backrest (13) is connected to the second frame (12) through second elastic means (22) to allow a further rotary translatory motion.

13 Claims, 7 Drawing Sheets

ARMCHAIR WITH VARIABLE POSITION

The present invention relates to an armchair adapted to take variable positions due to the thrust action exerted on the seat and the backrest by the sitting person so as to follow the movements of said person.

Several types of chairs or armchairs are available on the market, in which the variable position is obtained by the static adjustments provided, as well as by the dynamic features of the peculiar elastic deformability of the seat or back structure or elastic means interposed between the structural elements of the chair.

Pressure exerted by the sitting person on the seat or the backrest or on both elements at the same time, modifies the chair position adjusting the position as far as possible to the new sitting position.

However, more particularly in the frequent changes from the sitting position crouching forward to the stretched position backward, the user feel the resistance of the chair structure to follow said movements. More particularly the user feels the annoying scraping against the surface of the seat or the backrest with consequent trouble and inconvenience.

Moreover the most natural positions the user aims to take, are often constrained only to the intrinsic elastic deformability of the seat and backrest padding without any actual possibility of adjustment when the user is sitting.

In order to remove said drawbacks, the international application of the same inventor published as document WO00/18274, discloses a chair with variable position allowing the sitting position to change from a sitting position crouching forward to another sitting position generally stretched backward. This is obtained merely exerting a thrust on the seat that changes its position relative to the chair support without scraping of the person sitting on the seat surface. Moreover the amount of position variation may be modified by acting on proper adjustment members.

The chair with variable position disclosed in said document has however the drawback to allow only straight seat movements back and forth along a plane. Another drawback consists in that seat and backrest are connected to each other, leading to an undesired constraint because a movement of the seat causes anyway a certain movement of the backrest.

In other words the movements of seat and backrest are interdependent and cannot be separated.

The U.S. Pat. No. 6,116,687 discloses a functional chair having a seat part connected to the head part of the pedestal via a joint comprising an elastomeric material which permits the tilting of the seat part.

The U.S. Pat. No. 4,640,548 discloses an adjustable chair having three horizontal transvers axes connecting the seat and the column, the column and the curved supporting bar and the curved supporting bar and the seat, respectively.

At least one axis permits both the swiveling motion and the relative shift.

The U.S. Pat. No. 4,986,601 discloses a tilting mechanism for a seat able to tilt the seat both forward and backward. The supporting member on which the backrest is mounted is connected with this seat plate so that the supporting member acts interlockingly with that one of the seat plate.

The present invention aims at overcoming this limitation.

More particularly the object of the present invention is to provide a chair or armchair with variable position allowing a greater number of degrees of freedom in the movements of both the seat and the backrest.

Another object is to provide a chair in which seat and backrest can be moved independently from one another when desired.

A last but not least object is to provide a chair allowing movements of both seat and backrest forward, backward, laterally and even on planes other then the original rest ones.

Said objects are attained by an armchair with variable position the main features of which are according to claim 1.

According to a preferred embodiment the support structure consists of a plurality of radially arranged bearing elements connected to the lower end of the support post.

Advantageously in view of the combination of the mutual sliding motion between seat and backrest and of the degree of freedom given by the elastic means to both seat and backrest, the rotary translatory movement of the seat is generated also on other planes than the initial resting plane and a movement of the backrest which is substantially independent from the movement of the seat, so that the user's back is always leaning on the backrest even when changing his rest position on the seat, for instance in case of changing crossing of the legs.

Said objects will be more apparent by reading the following description of preferred embodiments of the chair of the invention with reference to the accompanying sheets of drawings in which.

Figure 1:
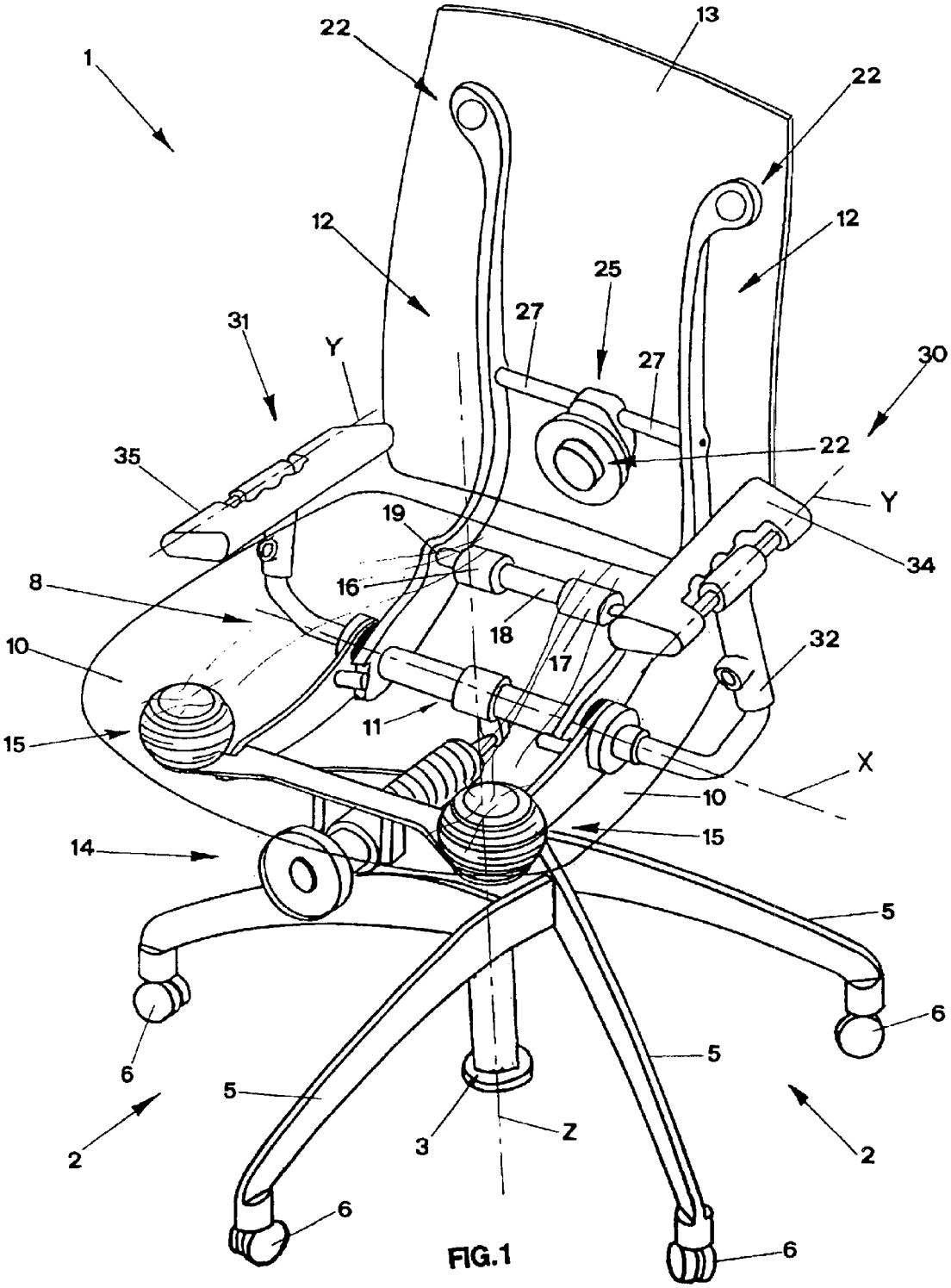
FIG. 1 is an isometric view of the armchair of the invention.

The armchair of the present invention is shown in FIG. 1 where it is generally indicated with reference numeral 1.

The armchair consists of a support structure generally indicated with numeral 2 comprising a post 3 defining a first vertical longitudinal axis Z. In this embodiment, the post 3 is the rod of a pneumatic cylinder 3*a* adapted to adjust the height of the seat of the armchair. The upper end 4 of cylinder 3*a* is connected to a plurality of spokes 5 resting on the ground, radially arranged and provided with wheels 6 adapted to allow the chair 1 to slide on the floor.

Figure 2:
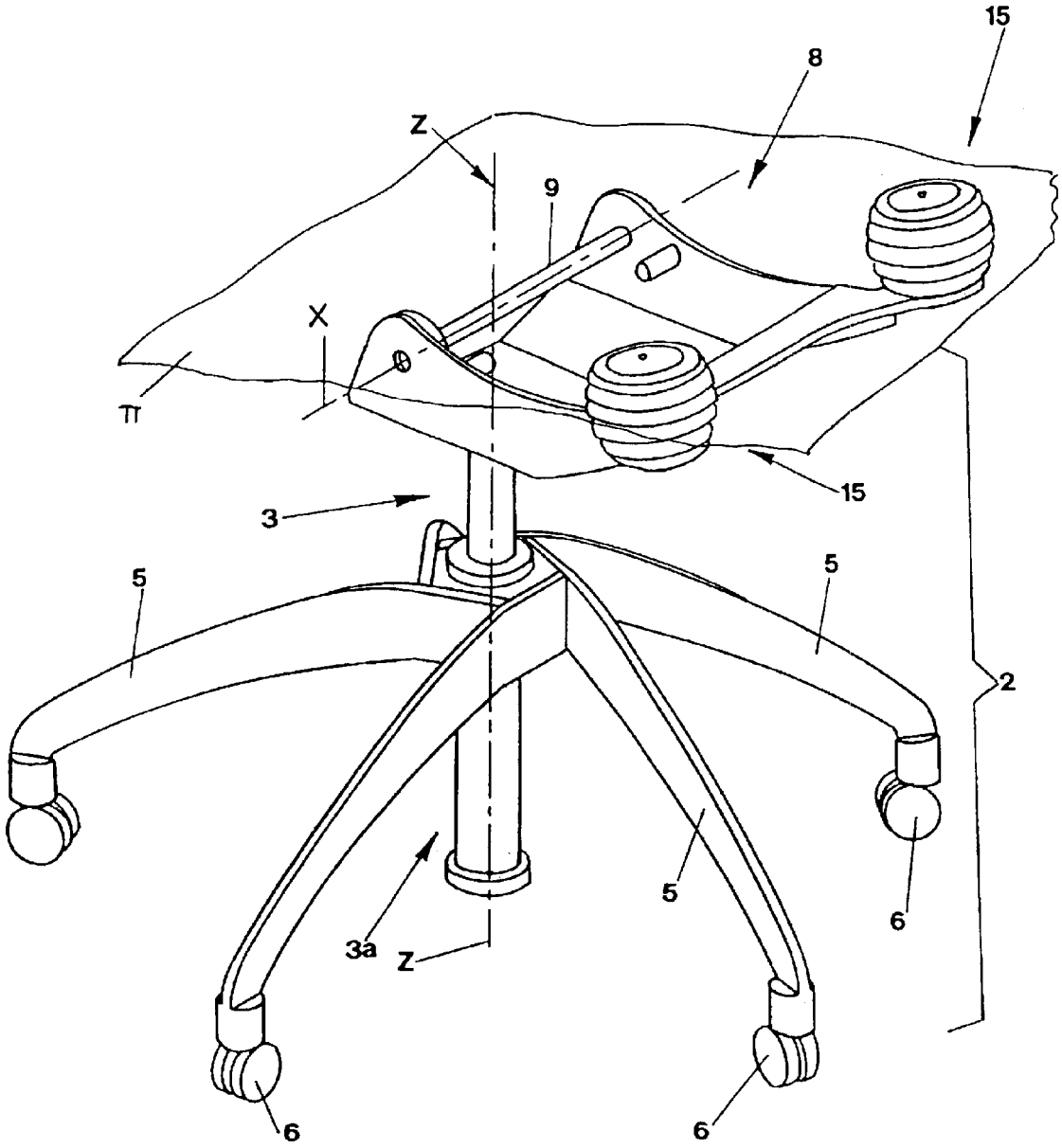
FIG. 2 is an isometric view of a portion of the armchair of FIG. 1 without the seat.

The upper end 7 of the post 3 as shown in FIG. 2 is connected to a first frame generally indicated with numeral 8, of a generally quadrilateral form. Said frame is provided with a first pivot 9 defining a second horizontal longitudinal axis X orthogonal to the vertical axis Z supporting a seat 10.

Figure 3:
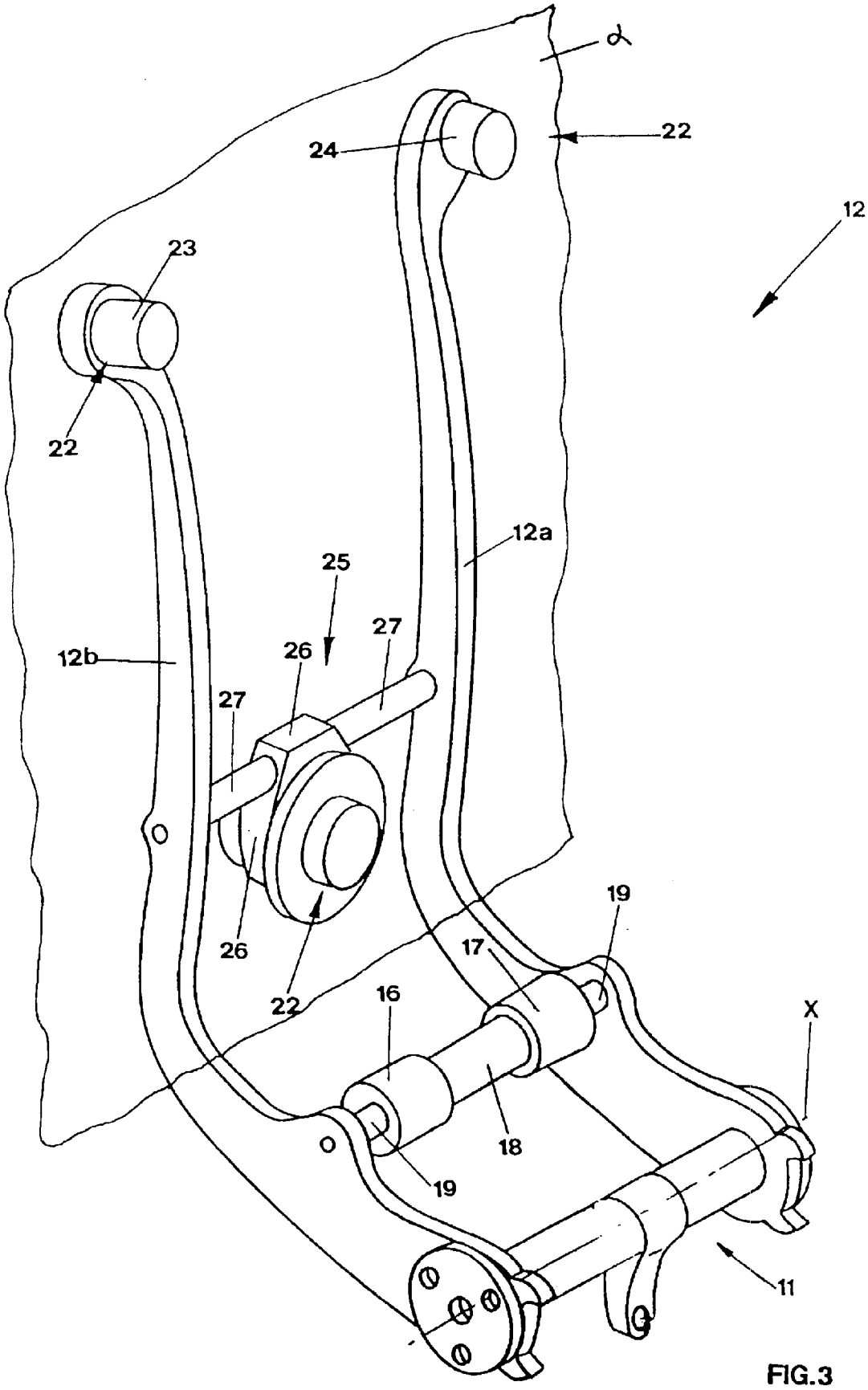
FIG. 3 is an isometric view of another portion of the armchair of FIG. 1 without the backrest.

The lower end 11 of a second frame 12 is pivoted to the first pivot 9 and has two facing and spaced arms 12*a*, 12*b* as shown in detail in FIG. 3 and supporting the backrest 13 of the arm chair of the invention.

The static balance of the second frame 12 is warranted by thrust means generally indicated with numeral 14, connected to the first frame 8 and acting against the end 11 of the second frame 12 so as to resist the swinging movement around the longitudinal axis X to which said second frame would be compelled under the thrust of the user's back.

The invention provides for the connection of the seat 10 to the first frame 8 through first elastic means generally indicated with numeral 15, arranged under the front part of the seat and adapted to allow a rotary translatory motion in combination with other rear bearing elements that will be described below (on a generally spherical surface π defined by the points where the seat 10 rests on the elastic means 15 and on the rear bearing elements).

Figure 9:
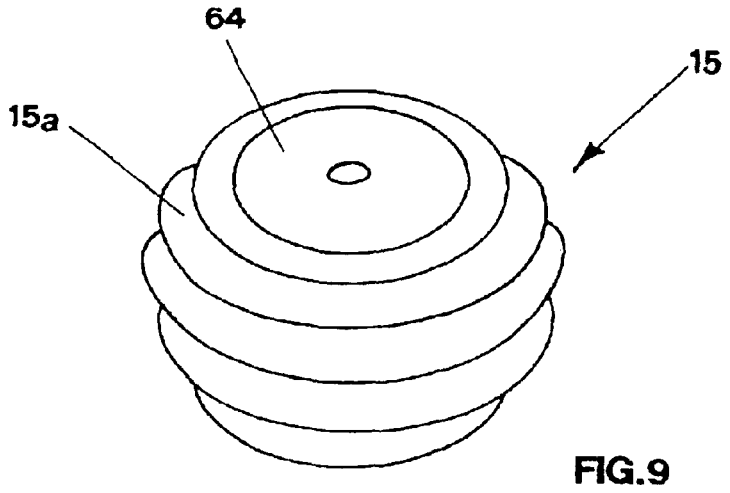
FIG. 9 is an isometric view of an elastic means of the armchair of FIG. 1.
Figure 10:
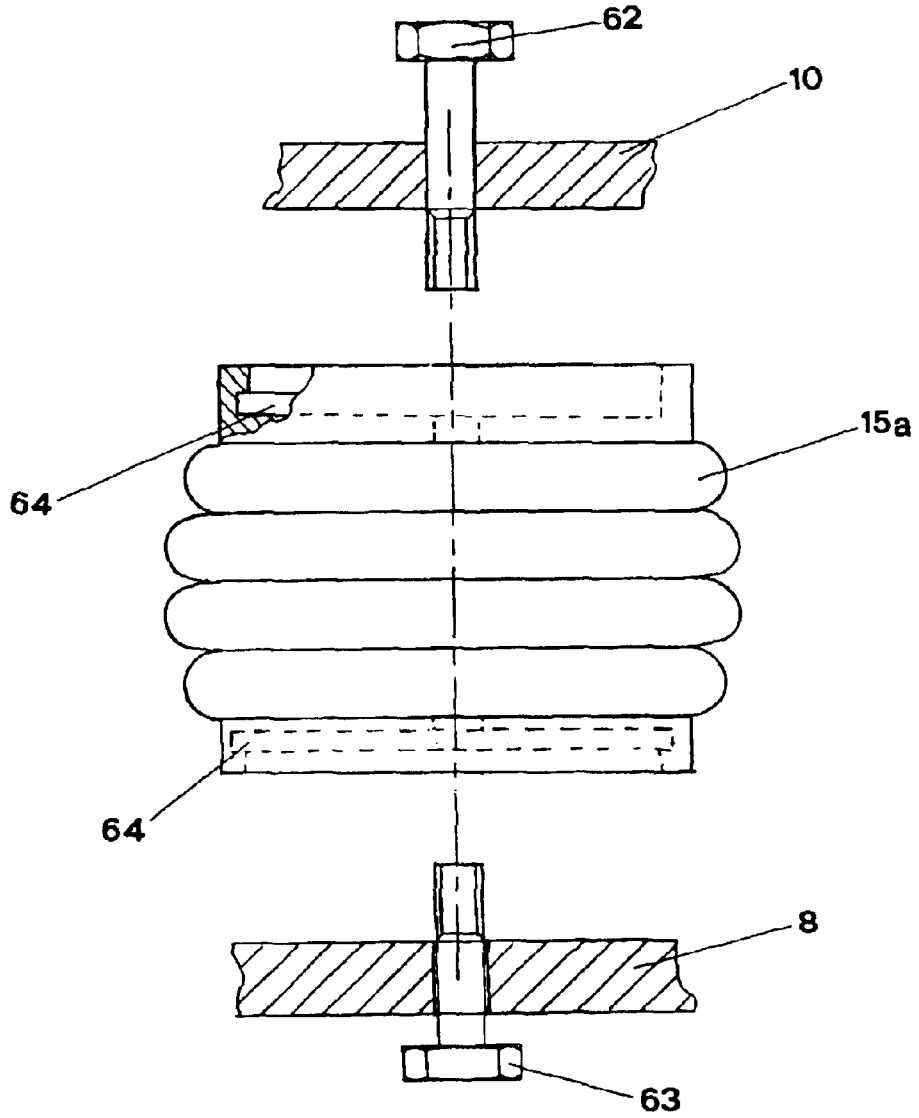
FIG. 10 is an exploded, partially sectional side view of the elastic means of FIG. 9.

Each first elastic means 15 comprising an elastic yielding body 15*a* that in this embodiment is a bellows with a shape comparable to the spherical one as shown in detail in FIGS. 9 and 10. Said elastic means is associated to the first frame 8 and to the seat 10 through fastening means 61 consisting of a couple of screws 62, 63 engaged in corresponding nuts made in a couple of discs 64 integral with said body 15*a*.

It is clear that in different embodiments the fastening means may consist of other joining elements with or without interposition of washers instead of screws and nuts, and the elastic body 15*a* preferably made of an elastomeric material, may take a prismatic shape.

The seat 10 as shown in FIG. 1, at the rear part is resting on two sliding tubular members 16, 17 spaced from one another through a spacing element 18 and idly coupled to a second pivot 19 connected to the second frame 12.

The tubular members 16, 17 have also their outer surface conjugated to the lower generally spherical surface of seat 10 resting on the members 16, 17.

It is important to note that when the seat 10 is moving also transversally under the thrust of the sitting person changing his position the tubular members 16 and 17 bearing the rear part of the seat are rotating in the opposite direction even at different angles. This movement combined with the extreme versatility of the front bellows bearings 15, allows the seat to take the most diversified positions following the movements of the sitting person even along planes which are not necessarily horizontal.

As to the backrest 13, it is connected to the second frame 12 through second elastic means fixed to the arms 12*a*, 12*b* and generally indicated with 22, adapted to allow a free rotary translatory motion on a generally plain surface α defined by the points where the backrest 13 is leaning on said second elastic means 22.

Said second elastic means 22 comprise an upper part consisting of a couple of cylindrical bodies 23, 24 made of elastomeric material and a lower part consisting of a pressure element 25 slidingly and rotatably coupled to a third support pivot 27 connected to the second horizontal frame 12. It is to be noted that nothing prevents that the elastic bodies 23, 24 are also bellows elements like the elements of the seat indicated with numeral 15.

Figure 4:
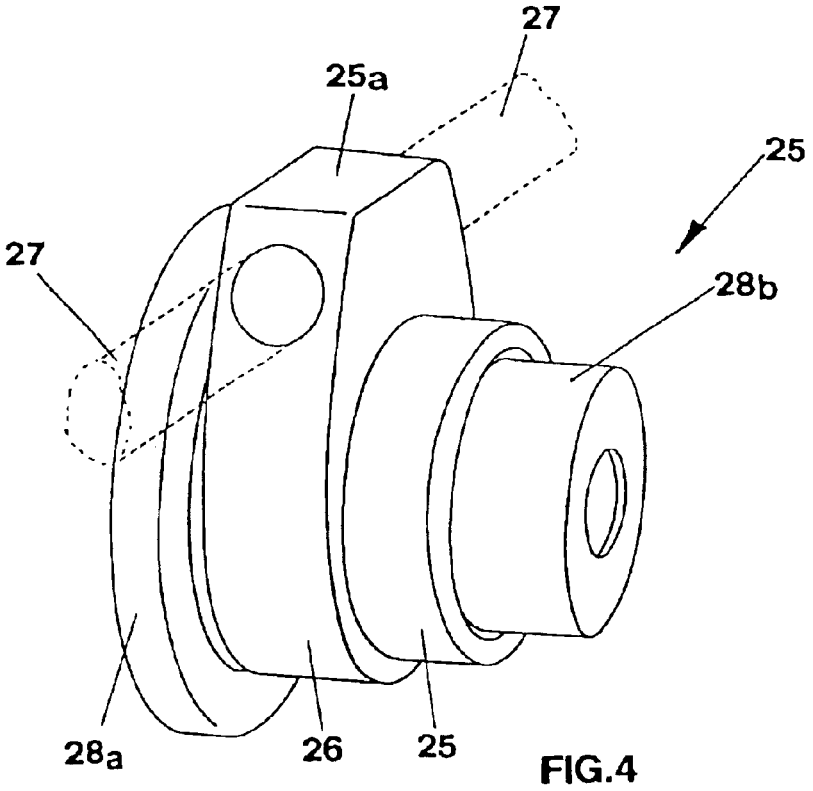
FIG. 4 is an isometric view of a device acting on the backrest of the armchair of FIG. 1.
Figure 5:
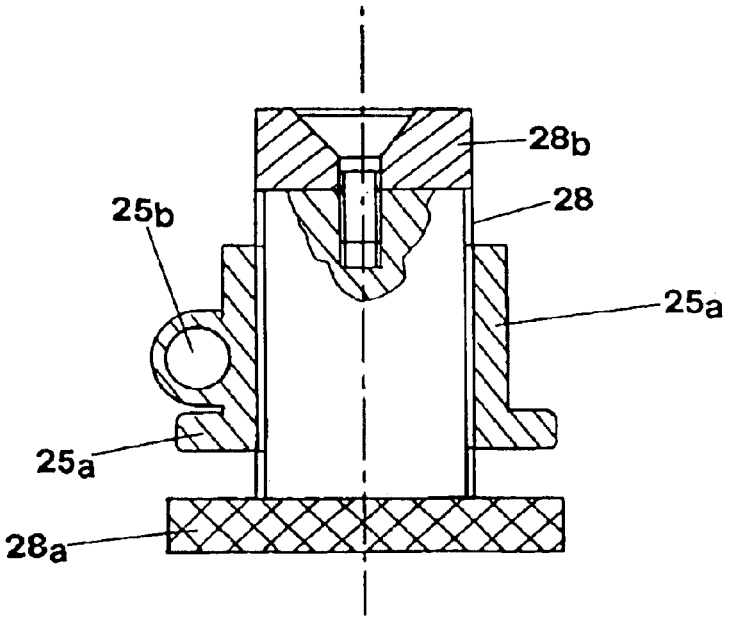
FIG. 5 is a longitudinal exploded sectional view of the device of FIG. 4.

The pressure element 25 shown in detail in FIGS. 4 and 5, comprises a first tubular member 26 internally threaded and provided with a transversal through hole 26*b* adapted to slidingly receive the pivot 27. A second tubular element 28 externally threaded and provided with an actuation knob 28*a*, can be screwed to the first element so as to change the length and therefore the thrust exerted by the elastic element 28*b* connected to the second element 28.

The user acting on the knob 28*a* thus can vary at will the length of the pressure element 25 so as to obtain a variation of the rest inclination of the backrest 10 relative to the vertical axis Z, until he finds the most comfortable position.

Figure 6:
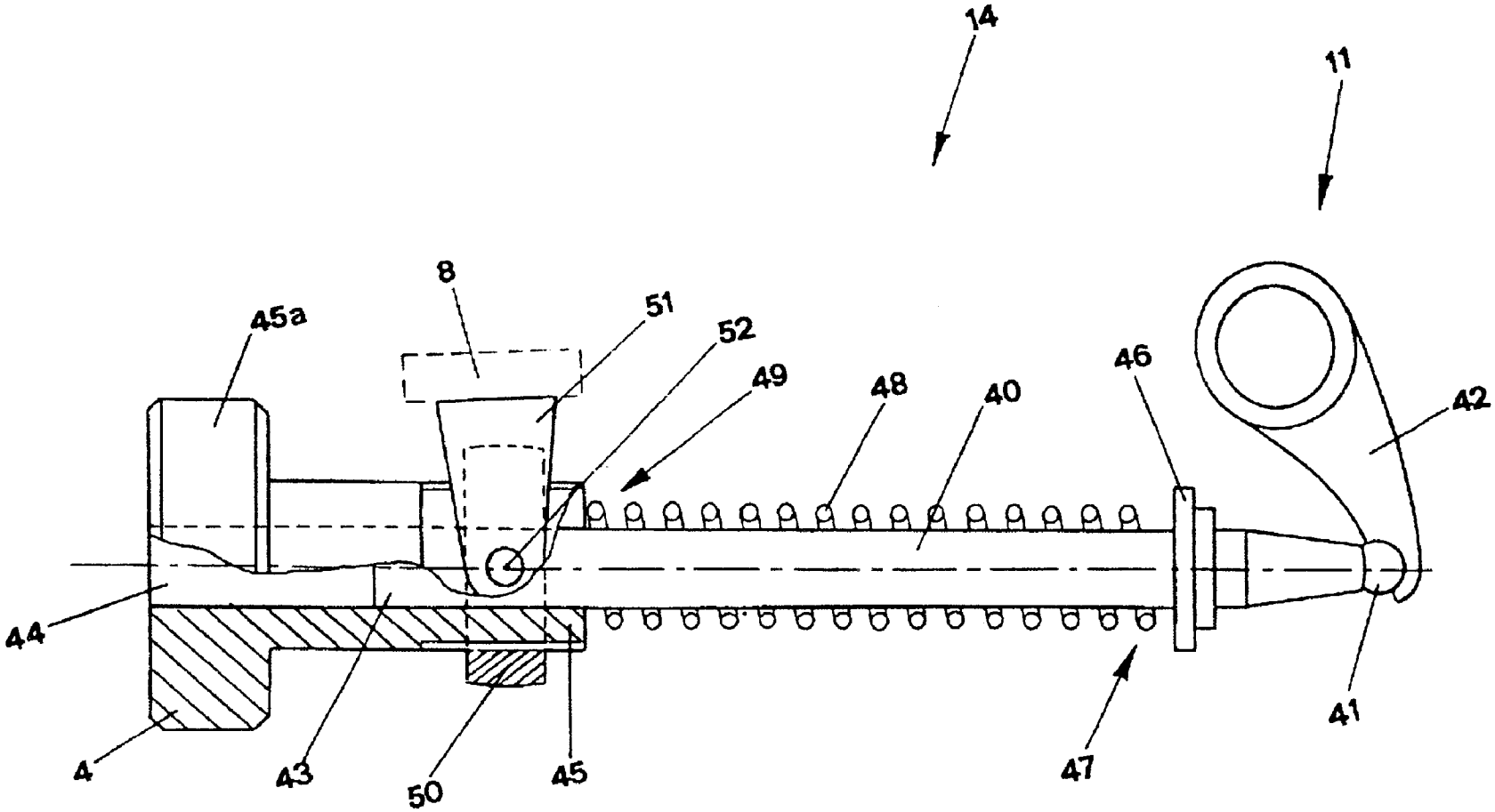
FIG. 6 is a longitudinal sectional view of another element of the armchair of FIG. 1.

As to the thrust means 14 shown in FIG. 6, they consist of a stem 40 having a first end provided with a spherical head 41 and a second end 43 slidingly coupled in a guide hole 44 made in a sleeve 45.

The spherical head 41 is coupled to a conjugated seat made in a lever arm 42 belonging to the end 11 of the second frame 12.

The sleeve 45 is provided with an actuation knob 45*a* and has a threaded outer surface coupled to a corresponding internally threaded ring 50 connected to a fork 51.

The ring 50 is fixed to the fork 51 through a couple of coupling pins 52 allowing its free rotation around the axis defined by said pins.

The stem 40 is also provided near its first end, with a compression disc 46 resisting the end 47 of a helical spring 48 coaxially coupled to said stem 40 and having its second end 49 opposed by the sleeve 45.

The user acting on the knob 45*a* screws or unscrews the sleeve 45 compressing or decompressing the spring 46 so as to vary the thrust exerted on the end 11 of the second frame 12 which is made more or less rigid.

The adjustment of the thrust is a function of the weight of the person sitting on the armchair so that the thrust means 14 is to be adjusted only once and then kept at the constant adjustment.

Figure 7:
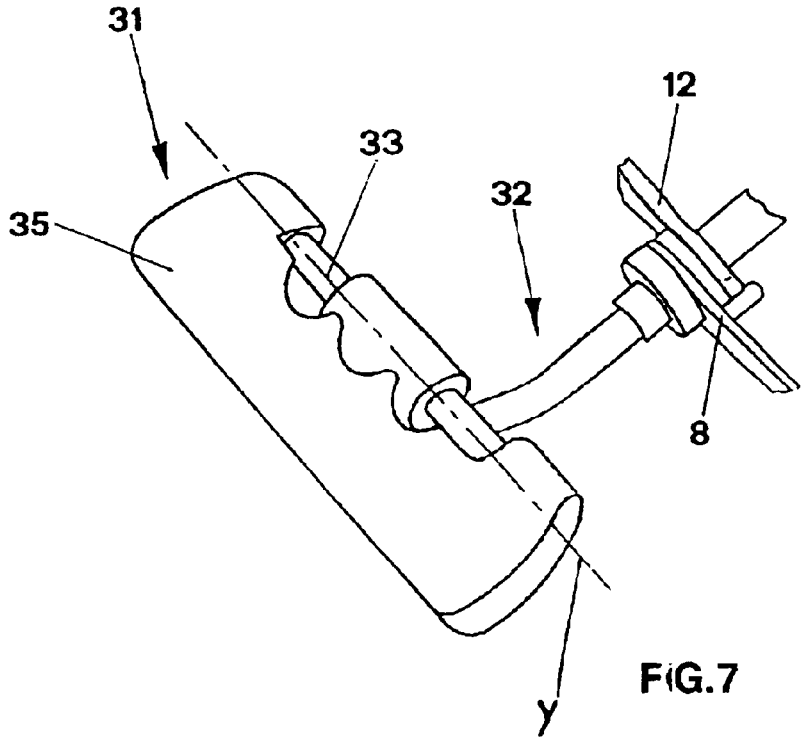
FIG. 7 is an isometric view of an armrest of the armchair of FIG. 1.
Figure 8:
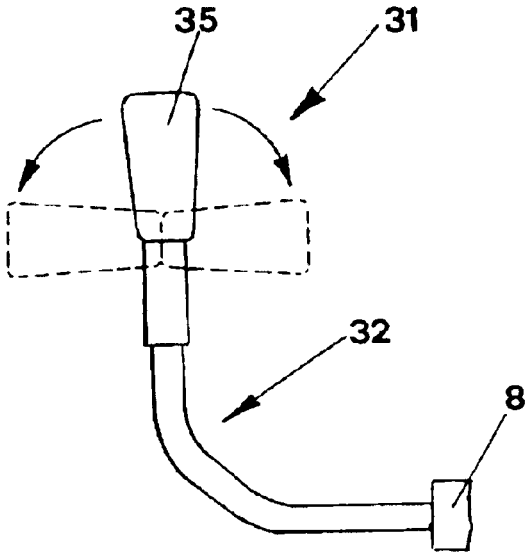
FIG. 8 is a front view of the armrest of FIG. 7.

Still according to the invention the armchair 1 comprises also a couple of armrests 30, 31 shown in FIGS. 7 and 8. Each armrest comprises a third frame 32 anchored to the first frame 8 and supporting a guide member 33 defining a third longitudinal axis Y orthogonal to the longitudinal axis X, the resting portions 34, 35 of the armrests 30 and 31 respectively being slidingly and rotatably coupled to said guide element. This allows the portions 24, 25 to be tilted by a rotation of 90° degrees clockwise or counterclockwise around said longitudinal axis Y respectively.

With the armchair according to the invention when the sitting person exerts a thrust against the seat 10 or the backrest or both, the pressure force is discharged on the elastic means 15 of the seat and those 22 of the backrest so that the generated force is resolved along the axes X and Z as defined hereinbefore.

Therefore the seat 10 is moved according to a motion resulting from the combination of the movements due to the forces acting along the axes X and Z, however remaining on the spherical surface n on which the seat is lying when in the rest condition.

As to the backrest 13, it may swing around the axis X while the thrust element 14 opposes to said movement a force equal to a quantity selected by the user acting on the actuation means provided for said thrust element.

In connection with said swinging motion the backrest 13 may also have although not necessarily, a rotary translatory motion along the plane α defined by the second elastic means.

In this connection it is to be noted that the seat and the backrest are free to move along their own planes π and α respectively, either independently or in a related way according to the nature and complexity of the movements of the person when sitting on the armchair.

The user may also change the height of the seat by acting on the support sleeve 3 and selecting the position of the backrest as previously described, acting both on the thrust means and the pressure element.

It is clear that the chair of the invention herein described and illustrated, may be constructed with any shape and dimensions and may also have different constructional versions as to the elastic means and the connection elements.

Although the invention was described by making reference to the FIGs. shown in the accompanying sheets of drawings, it may undergo several modifications and constructional variations, all falling however in the scope of the invention set forth in the appended claims.

What is claimed is:

1. An armchair with variable position comprising:

a support structure resting on the ground and having a post defining a first generally vertical longitudinal axis;

a first frame supported by said post comprising a first pivot defining a second generally horizontal longitudinal axis orthogonal to said first longitudinal axis;

a second frame swinging at one end around said first pivot; thrust means connected to said first frame and acting against said end of said second frame to resist the swinging movement of said second frame around said second longitudinal axis;

an elastic bellows secured to the frame and the seat;

a seat supported by said first frame and connected to it through said bellows;

a backrest supported by said second frame and connected to it through second elastic means;

wherein said seat is connected to said first frame through first elastic means and through rear bearing elements, said first elastic means and said rear bearing elements allowing a rotary translatory motion around a generally spherical surface ($\pi$) said rear bearing elements being able to revolve in two opposite directions during the transversal movement of said seat, and wherein said backrest is connected to said second frame through second elastic means allowing a further rotary translatory movement of said backrest.

2. The armchair according to claim 1, wherein said rear bearing elements consist of at least two sliding tubular elements idly coupled to a second support pivot connected to said second frame.

3. The armchair according claim 1, wherein said bellows comprises an elastically yielding body made of elastomeric material.

4. The armchair according to claim 1, wherein the bellows has a prismatic frustum conical shape.

5. The armchair according to claim 1, wherein said second elastic means comprises a pressure element anchored to a tubular member slidingly and rotatably coupled to a third support pivot connected to said second frame.

6. The armchair according to claim 5, wherein said at least one pressure element is adjustable to change the thrust exerted on said backrest adjusting its inclination relative to said vertical axis (Z).

7. The armchair according to claim 5, wherein said rotary translatory movements of said seat and said backrest are independent from each other.

8. The armchair according to claim 5, wherein one or more armrests defining a third longitudinal axis (Y) generally orthogonal to said second longitudinal axis (X) are associated to said first frame.

9. The armchair according to claim 8, wherein each of said one or more armrests can be tilted along said third longitudinal axis (Y).

10. The armchair according to claim 8, wherein each of said one or more armrests are movable along said third longitudinal axis (Y).

11. The armchair according to claim 1, wherein said thrust means comprises a stem having a first end acting against said end of said second frame, and a second end slidingly coupled in a guide hole made in a sleeve connected to said first frame, a helical spring being interposed between the ends and coaxially coupled to said stem having a first end resisted by a compression disc connected to said stem and a second end resisted by said sleeve.

12. The armchair according to claim 11, wherein said second elastic means comprises a pair of cylindrical bodies made of elastomeric material and at least a pressure element slidingly and rotatably coupled to a third support pivot connected to said second frame.

13. The armchair according to claim 12, wherein said pressure element comprises a first internally threaded tubular element provided with a transversal through hole adapted to slidingly receive said third pivot and a second externally threaded tubular element.

* * * * *